US006843162B2

(12) United States Patent
Shrive et al.

(10) Patent No.: US 6,843,162 B2
(45) Date of Patent: Jan. 18, 2005

(54) RADIAL PISTON ENGINE

(75) Inventors: Chris Shrive, Fife (GB); Sinclair Cunningham, Kirkcaldy (GB)

(73) Assignee: Bosch Rexroth AG, Lohr (DE)

( * ) Notice: Subject to any disclaimer, the term of this patent is extended or adjusted under 35 U.S.C. 154(b) by 0 days.

(21) Appl. No.: 10/257,592

(22) PCT Filed: Mar. 27, 2001

(86) PCT No.: PCT/EP01/03480

§ 371 (c)(1),
(2), (4) Date: Mar. 11, 2003

(87) PCT Pub. No.: WO01/77495

PCT Pub. Date: Oct. 18, 2001

(65) Prior Publication Data

US 2003/0159578 A1 Aug. 28, 2003

(30) Foreign Application Priority Data

Apr. 11, 2000 (DE) ..... 100 17 951
Jul. 10, 2000 (DE) ..... 100 33 264

(51) Int. Cl.[7] ..... F01B 1/06
(52) U.S. Cl. ..... 91/491; 91/498
(58) Field of Search ..... 92/72; 91/498, 91/491; 417/221, 222.2, 273, 554, 547

(56) References Cited

U.S. PATENT DOCUMENTS 3,511,131 A * 5/1970 Kress ..... 91/176
4,724,742 A * 2/1988 Bigo et al. ..... 91/491
5,836,231 A * 11/1998 Leinonen ..... 91/491
6,161,508 A * 12/2000 Lindblad ..... 123/44 B

FOREIGN PATENT DOCUMENTS

DE 900 530 * 7/1949
DE 90 05 30 12/1953
DE 24 44 040 9/1974 ..... F01B/13/06
DE 34 34 350 3/1986 ..... F04B/1/04
DE 0 263 218 A1 * 4/1988 ..... F04B/1/04

* cited by examiner

*Primary Examiner*—Charles G. Freay
(74) *Attorney, Agent, or Firm*—Boyle Fredrickson Newholm Stein & Gratz S.C.

(57) ABSTRACT

What is disclosed is a radial piston machine having a plurality of radial pistons each guided in a respective cylinder space, wherein the cylinder spaces may be connected with supply and drain passages for pressure medium via control recesses. The opening cross-sections of the control recesses and of the supply and drain passages are provided with curved end face portions.

16 Claims, 3 Drawing Sheets

RADIAL PISTON ENGINE

BACKGROUND OF THE INVENTION

1. Field of the Invention

The invention relates to a radial piston machine and, more particularly, a radial piston machine that efficiently minimizes flow losses.

2. Description of the Related Art

From DE 40 049 32 C2 a radial piston machine is known, wherein a cylinder block having a multiplicity of radially disposed cylinder spaces is rotatably mounted in a housing. In each cylinder space one piston is guided, the end portion of which protrudes from the cylinder block and is supported on a cam ring. This cam ring has a multiplicity of control cams effecting a radial displacement of the pistons concurrently with a rotation of the cylinder block. In the housing of the radial piston machine, supply and return passages for pressure medium are formed which may alternatingly be made to coincide with control recesses in the cylinder block with the aid of which the supply and discharge of pressure medium to and from the cylinder spaces may be controlled.

In the embodiment described in DE 40 049 32 C2, the control recesses in the cylinder and the opening cross-sections in the housing are realized with a circular cross-section. It is a drawback in a like solution that the connections with the cylinder spaces are controlled open or closed comparatively slowly on account of the circular control cross-sections, so that flow losses may occur.

This drawback is overcome by a solution disclosed in EP 0 263 218 B1 wherein the control cross-sections are formed to be not circular but approximately trapezoidal. The lateral surfaces of these trapezoidal cross-sections may be designed to be curving inward, or planar.

Although it is possible with such a solution to minimize flow losses upon controlling the connection with the cylinder spaces open or closed, considerable expense in terms of production technology is necessary in order to form the trapezoidal control recesses.

SUMMARY OF THE PRESENT INVENTION

In contrast, the preferred embodiment is based on the objective of furnishing a radial piston machine that is subject to minimum flow losses and may be manufactured at minimum expense in terms of production technology.

This object is attained through a radial piston machine constructed according to the present invention.

In accordance with the invention, the recesses for controlling pressure medium supply and discharge are designed with curved end faces, wherein end faces are meant to designate the circumferential surface portions located inward or outward in a radial direction. Such curved end faces may be produced substantially more easily than the straight end face portions known from EP 0 263 218 A1, so that the expense in terms of production technology is minimized. Such a control cross-section may be adapted through the extent of the control recess in a radial direction without an enlargement of the width (crosswise to the radial direction) being necessary.

The radius of curvature of the radially inner end face portion is preferably designed to be smaller than the one of the radially outer end face portion.

In the solution known from DE 40 049 32 C2, the increase of the control cross-section is possible only by increasing the diameter. As the control recesses and the opening cross-sections are, however, preferably executed with zero overlap, the maximum width of the control recesses and opening cross-sections is limited, so that the bore diameter cannot be increased at will in the known solution.

In accordance with the invention it is preferred if the end face portions each present a uniform radius of curvature, so that it is possible to form them by bores. Thus it is possible to form the end face portions with the aid of two through bores.

Producing the recesses is particularly simple if the two bores overlap each other, so that the recesses themselves may be executed by forming the two bores, to then have an approximately figure eight-shaped cross-section.

As an alternative, the curved end faces may be interconnected via tangential surfaces. At different radii of curvature, the intersection of the two tangential surfaces is situated in the plane of symmetry of the control cross-section tapering inward in the radial direction.

Manufacture is particularly simple if the geometry of the control recesses on the cylinder block side and of the opening cross-sections on the housing side is selected to be identical. As was already mentioned above, it is preferred for the opening cross-sections and the control recesses to be executed with zero overlap relative to each other, so that it is possible to control the connection with the cylinder spaces open and closed with maximum speed.

Manufacture of the control recesses and of the opening cross-sections may be simplified further if these are each formed in a cam disc fastened on the cylinder block or on the housing.

Further advantageous developments of the invention are subject matters of the further subclaims.

BRIEF DESCRIPTION OF THE DRAWINGS

In the following, preferred embodiments are explained more closely by referring to schematic drawings, wherein.

DETAILED DESCRIPTION OF THE PREFERRED EMBODIMENTS

Figure 1:
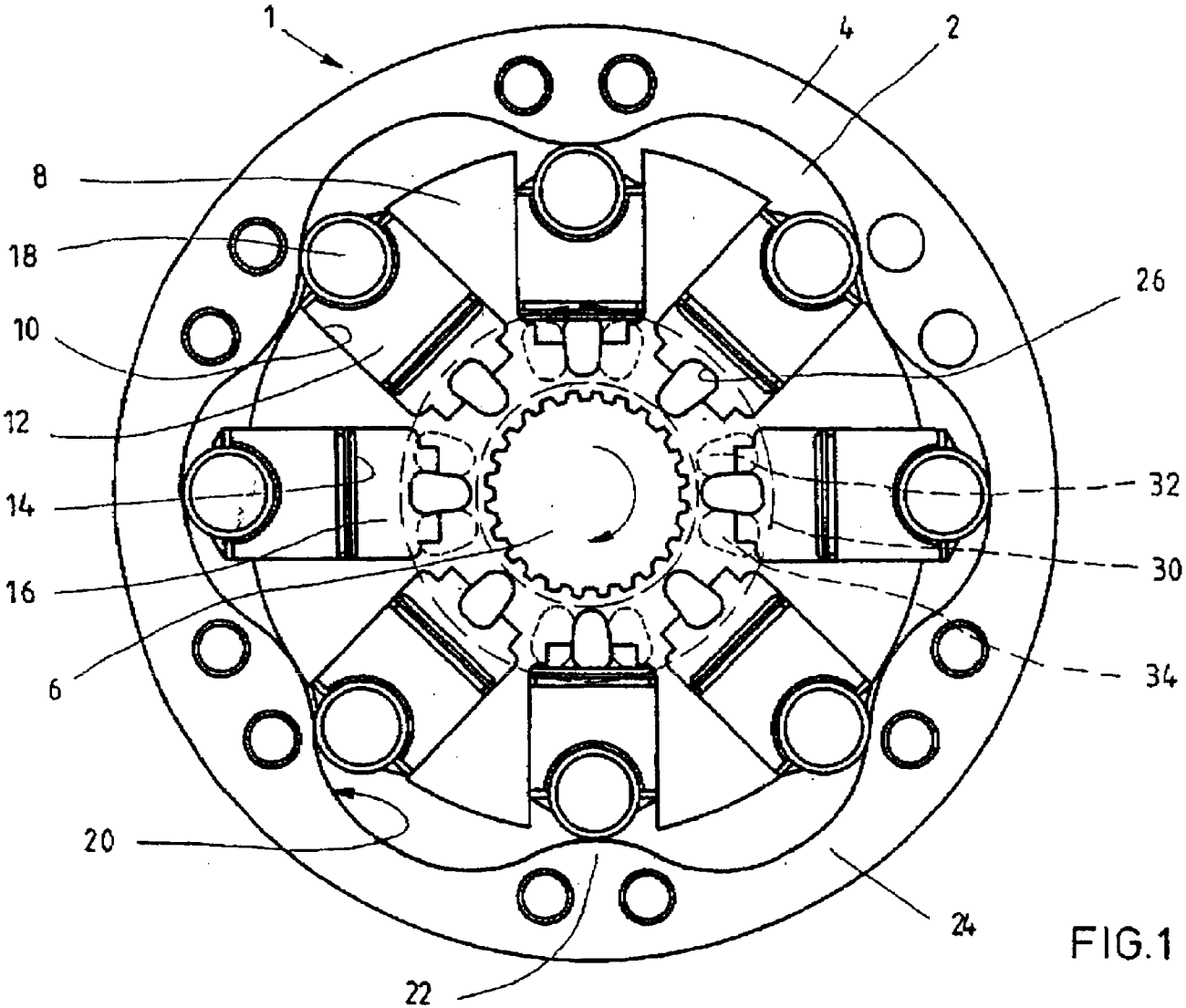
FIG. 1 is a cross-sectional view of a radial piston motor.

FIG. 1 shows a strongly simplified sectional view of a radial piston motor 1 constructed in accordance with the principle of multiple strokes. This radial piston motor 1 has a housing 2 to which a cam ring 4 is screw-connected. Within the housing 2 an output shaft 6 is mounted which is connected via external teeth to a cylinder block 8 having the form of a rotor. In the represented embodiment, eight cylinder bores 10 are formed in the cylinder block 8, in which bores one respective piston 12 each is guided so as to be radially displaceable. Between the radially inner piston bottom 14 and the bottom of the cylinder bore 10 one respective cylinder space 16 is defined into which pressure medium may be fed. At the end portion of each piston 12 which is removed from the cylinder space 16, a roller 18 is mounted, with these rollers rolling on a control disc 20 of the cam ring 4 during a rotational movement of the cylinder block 8.

As can be seen in the representation in accordance with FIG. 1, the control disc 20 is designed with 6 radially protruding control cams 22. While ascending on these control cams 22, the pistons 12 are displaced radially inward in the direction of their inner dead centers. Between two adjacent control cams 22 one respective valley 24 is formed, so that the pistons 12 assume their external dead centers, in which the cylinder spaces have a maximum volume, at the deepest points of the valleys 24.

To each one of the cylinder spaces 16 there is associated a control recess 26 which is formed in the cylinder block 8 and through which the pressure medium is supplied or discharged in accordance with the piston position. In the represented embodiment, eight control recesses 26 corresponding to the number of pistons are distributed on a partial circle at the periphery.

The representation in accordance with FIG. 1 indicates in phantom line the inner and outer periphery of a control housing 30 which is inserted into the housing 2 behind the plane of drawing and hidden by the cylinder block 8. In this control housing 30 supply and drain passages 32, 34 are formed which are also only indicated in phantom line in the representation in accordance with FIG. 1. In accordance with the number of control cams 22, six supply passages 32 and six drain passages 34 each open on the front face side in regular distribution over a partial circle whose diameter corresponds to that of the partial circle of the control cross-sections 26. In the representation in accordance with FIG. 1 it should be noted that the cross-sections of the supply and drain passages 32, 34, which are inclined at 45° with the horizontal and vertical, respectively, are covered by the control recesses 26 drawn in solid lines.

The supply passages are open towards a first ring passage located radially between the control housing 30 and the housing 2 and connected with a supply port at the housing 2, and the drain passages 34 are open towards a second ring passage which, at an axial spacing from the first ring passage, also is located radially between the control housing 30 and the housing 2 and is connected with a drain port on the housing 2.

Depending on the constructional design, the control recesses 26 and/or the opening cross-sections of the supply and drain passages 32, 34 may be present as axial bores in the cylinder block 8 or, respectively, in the control housing 30 which is only indicated schematically, or, in turn—similar to the embodiments described in EP 0 263 218 A1 as mentioned at the outset—in cam discs placed on the cylinder block 8 or on the control housing, respectively, and formed only by the respective opening regions of the associated passages. Such cam discs forming the opening cross-sections may be produced more easily than recesses bored or milled in the housing 2 or in the cylinder block 8.

Figure 2:
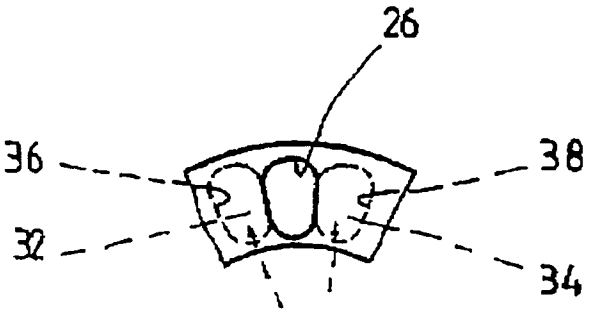
FIG. 2 is a detail representation of a cam disc for controlling pressure medium supply and discharge to cylinder spaces of the radial piston machine.
Figure 3:
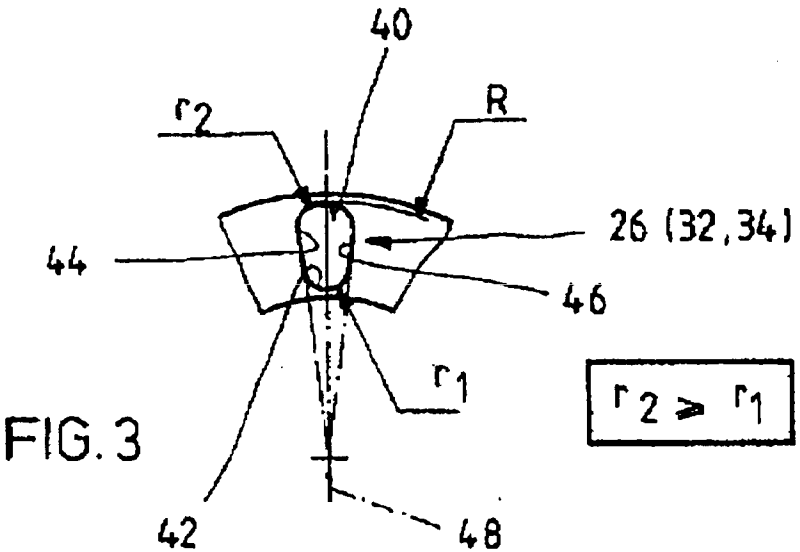
FIG. 3 shows geometrical details of a control recess of the cam disc of FIG. 2.

In FIGS. 2 and 3 the geometrical relations of a control recess 26 and of the associated opening cross-section of supply and drain passages 32, 34 are represented. As was already mentioned, the opening cross-sections 36, 38 of the passages 32 and 34 as well as the control recesses 26 are executed with an identical geometry which is described by referring to FIG. 3. In this represented embodiment, the end face portions 40, 42 having a relative diametrical arrangement in the radial direction are each executed with a radius $r_2$ and $r_1$, respectively, with the radius $r_2$ of the radially outer end face portion 40 being larger than the radius $r_1$ of the radially inner end face portion. In an extreme case, both end faces 40, 42 may be executed with identical radii r.

In the embodiment represented in FIGS. 2 and 3, the lateral surfaces 44 connecting the two end face portions 40, 42 have the form of surfaces tangential with the end face portions 40, 42, wherein these tangential planes intersect each other in the plane of symmetry 48 disposed in the radial direction. This intersection of the two tangential planes may, e.g., be located in the axis of the output shaft 6.

Such a recess 26 (32, 34) may be produced with utter ease as, for example, the two end face portions 42, 40 may be formed by bores, and subsequently the tangential surfaces 44, 46 may be formed by milling or the like.

As can particularly be seen in FIG. 2, the geometries and the distance of two adjacent opening cross-sections 36, 38 are selected such that in the represented relative position, a control recess 26 may be arranged between them with zero overlap. In this relative position the lateral surfaces 44, 46 of the control recess 26 are arranged to be in alignment in the axial direction with the adjacent lateral surfaces of the adjacent opening cross-sections 36, 38. I.e., in this relative position neither feed nor discharge of pressure medium to or from the associated cylinder space 16 takes place.

Upon further rotation of the control recess 26 relative to the opening cross-sections 36, 38, a large cross-section of the supply or drain passage 32, 34 is very rapidly controlled open by the comparatively long lateral surface 44 or 46, respectively, of the control recess 26, so that the flow losses during control processes are minimum.

Figure 4:
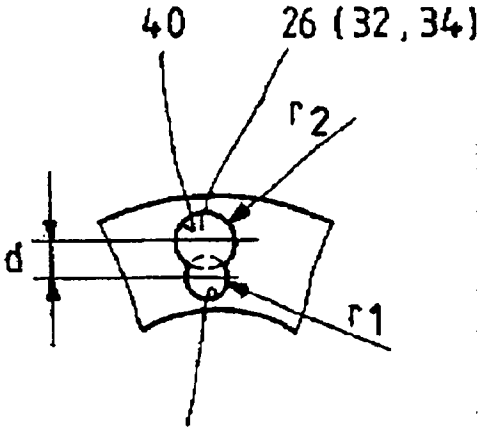
FIG. 4 shows a simplified development of a control recess for a cam disc in accordance with FIG. 2, and FIGS. 5 and 6 show further simplified embodiments of a control recess.

FIG. 4 shows a simplified embodiment wherein the expense for manufacturing the control recesses 26 and the opening cross-sections 36, 38 is further minimized in comparison with the above described embodiment. In the control recess 26 exemplarily represented in FIG. 4, the end face portions 40, 42 are formed—similar to the above described embodiment—by two bores having radii $r_1$ and $r_2$. The axial distance d of the two bores is smaller than the sum $r_1+r_2$, so that the two bores overlap each other. What results is an opening cross-section approximately having the shape of a figure eight, wherein the lateral surfaces projected inward are not processed like in the above described embodiment. In this simplified embodiment the simplified manufacture is achieved at the expense of slower opening and closing control of the supply and drain passages 32, 34, respectively.

Figure 5:
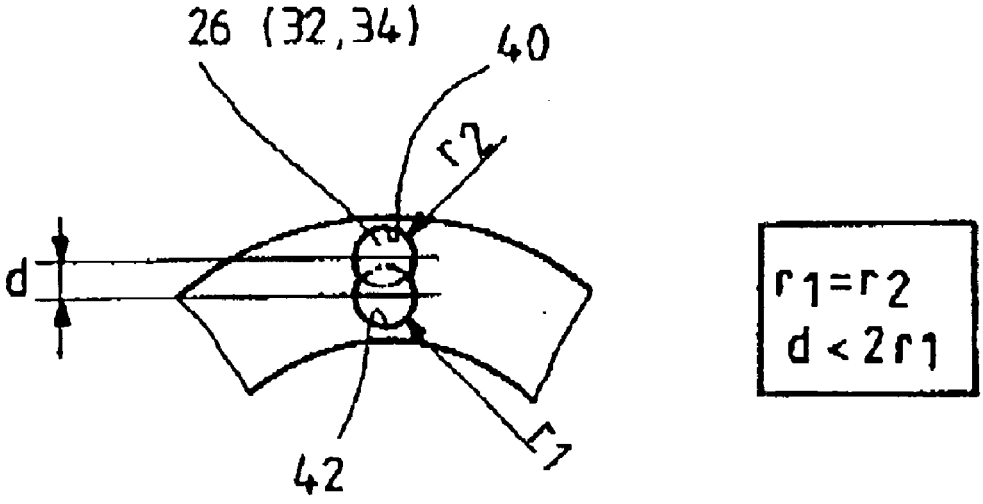
Figure 6:
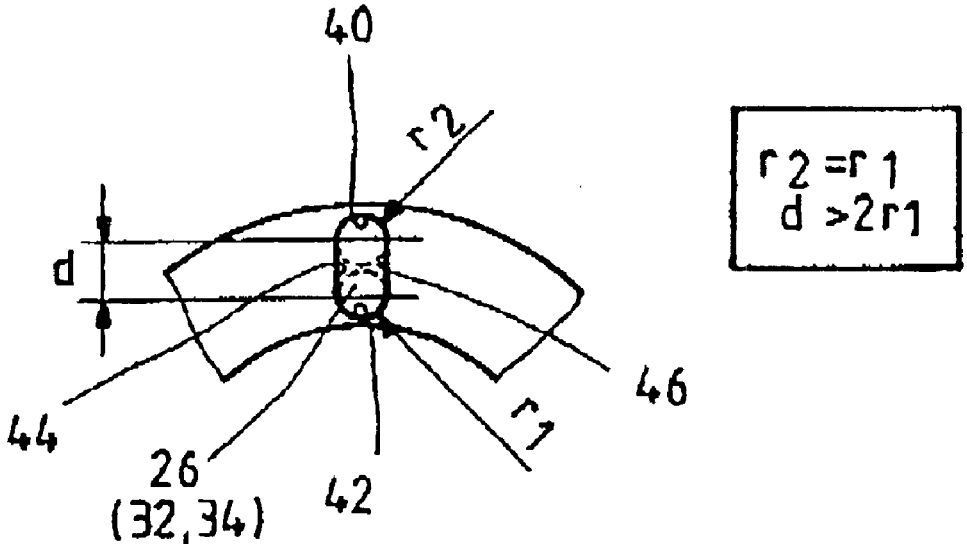

In the above described embodiments, the control recesses 26 taper in the radial direction towards the axis of the radial piston motor. FIGS. 5 and 6 show two further variants of a control recess 26 that may be manufactured even more easily in comparison with the above described solutions.

In the embodiment represented in FIG. 5, the control recess 26 is executed—similar to the embodiment described by referring to FIG. 4—as two mutually overlapping bores having the radii $r_1=r_2$. Overlapping of the two bores requires the distance d to be smaller than the dimension 2 $r_1$ (2 $r_2$). This variant may be produced in a simple manner, for example by boring, wherein no refitting of the drill as in the embodiment represented in FIG. 4 is required.

FIG. 6 finally shows an embodiment wherein the end face portions 40, 42 are also realized through two bores having the radii $r_2=r_1$. In this variant, the distance d between the two bore centers is greater than the sum of the two radii 2 $r_1$ (2 $r_2$), so that an overlap region does not exist. The two bore sections are then, as in the embodiment represented in FIG. 3, connected by tangentially extending lateral surfaces 44, 46, practically resulting in an oblong hole having a width equaling the radii $r_1$. I.e., in the variants shown in FIGS. 5, 6, the control recesses 26 are thus not realized to be tapering in a radial direction.

It is, of course, also possible to produce the above described cross-sections by other processing methods than drilling, such as, e.g., by milling, wire EDM or cavity sinking by EDM.

The surfaces of the opening cross-sections may be adapted to various requirements through suitable selection of the distance d between the end face portions, wherein the bore diameter(s) remain practically unchanged, so that zero overlap is ensured.

What is disclosed is a radial piston machine having a plurality of radial pistons each guided in a respective cylinder space, wherein the cylinder spaces may be connected with supply and drain passages for pressure medium via control recesses. The opening cross-sections of the control recesses and of the supply and drain passages are provided with curved end face portions.

What is claimed is:

1. A radial piston machine having a cylinder block which is mounted in a housing and in which a multiplicity of pistons guided in cylinder spaces and supported on a cam ring are mounted, and having a multiplicity of cylinder block-side control recesses capable of being made to coincide with opening cross-sections of housing-side supply and drain passages in order to control supply and drain, characterized in that at least one of said control recesses and said opening cross-sections have entirely curved end face portions and a greater longitudinal dimension in the radial direction than in the transverse direction.

2. A radial piston machine in accordance with claim 1, wherein the mean radius of a radially outer end face portion is greater than that of an inner end face portion.

3. A radial piston machine is accordance with claim 1, wherein said curved end face portions each have a uniform radius of curvature.

4. A radial piston machine in accordance with claim 2, wherein the centers of curvature of said outer end face portion and said inner face Portion are spaced apart from each other by less than the sum of the radii of curvature.

5. A radial piston machine in accordance with claim 1, wherein said end face portions are interconnected by lateral surfaces extending approximately tangentially thereto.

6. A radial piston machine in accordance with claim 4, wherein said end face portions are formed by two mutually overlapping bores.

7. A radial piston machine in accordance with claim 1, wherein the geometries of said control recesses and of said opening cross-sections are identical.

8. A radial piston machine in accordance with claim 1, wherein at least one of said control recesses and said opening cross-sections are each formed on a cam disc fixed at the end face side of said cylinder block and on said housing, respectively.

9. A radial piston machine in accordance with claim 1, wherein said control recesses and said opening cross-sections are formed with zero overlap.

10. A radial piston machine in accordance with claim 1, wherein the mean radius of curvature of a radially outer end face portion is greater than that of an inner face portion;

said end face portions each have a uniform radius of curvature;

the centers of curvature are spaced apart from each other by less than the sum of the radii of curvature;

said end face portions are interconnected by lateral surfaces extending approximately tangentially thereto;

the geometries of said control recesses and of said opening cross-sections are identical;

at least one of said control recesses and said opening cross-sections are each formed on a cam disc fixed at the end face side of said cylinder block and on said housing, respectively; and said control recesses and said opening cross-sections are formed with zero overlap.

11. A radial piston machine in accordance with claim 1, wherein said end face portions are formed by two mutually overlapping bores;

at least one of said control recesses and said opening cross-sections are each formed on a cam disc fixed at the end face side on said cylinder block and on said housing, respectively; and said control recesses and said opening cross-sections are formed with zero overlap.

12. A radial piston machine in accordance with claim 1, wherein said end face portions each have a uniform radius of curvature;

said end face portions are interconnected by lateral surfaces extending approximately tangentially thereto;

at least one of said control recesses and said opening cross-sections are each formed on a cam disc fixed at the end face side of said cylinder block and on said housing, respectively; and said control recesses and said opening cross-sections are formed with zero overlap.

13. A radial piston machine including a cylinder block in which one or more pistons translate, the machine comprising:

a cylinder block side control recess that coincides with opening cross-sections of supply and drain passages; and wherein at least one of said control recess and said opening cross-sections have entirely curved end face portions formed by two bores.

14. A radial piston machine in accordance with claim 13, wherein at least one of said control recess and said opening cross-sections have a greater longitudinal dimension in the radial direction than in the transverse direction.

15. A radial piston machine in accordance with claim 14, wherein the mean radius of curvature of said radially outer end face portion is greater than that of said radially inner face portion, wherein said end face portions each have a uniform radius of curvature, and wherein the centers of curvature are spaced apart from each other by less than the sum of the radii of curvature.

16. A radial piston machine having a cylinder block which is mounted in a housing and in which a multiplicity of pistons guided in cylinder spaces and supported on a cam ring are mounted, and having a multiplicity of cylinder block-side control recesses capable of being made to coincide with opening cross-sections of housing-side supply and drain passages in order to control supply and drain, wherein said control recesses and/or said opening cross-sections have a radially outer curved end face portion and a radially inner curved end face portion and a greater longitudinal dimension in the radial direction than in the transverse direction, characterized in that the two curved end face portions are formed by two bores.

* * * * *